US007789323B2

(12) United States Patent
Nelson et al.

(10) Patent No.: US 7,789,323 B2
(45) Date of Patent: Sep. 7, 2010

(54) DUAL-MODE SPRINKLER HEAD

(75) Inventors: Reid A. Nelson, Walla Walla, WA (US); Patrick T. Barry, Walla Walla, WA (US); Craig B. Nelson, Walla Walla, WA (US); Michael Townsend, Waitsburg, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 273 days.

(21) Appl. No.: 12/213,994

(22) Filed: Jun. 27, 2008

(65) Prior Publication Data

US 2009/0321537 A1 Dec. 31, 2009

(51) Int. Cl.
*B05B 3/04* (2006.01)

(52) U.S. Cl. ..... 239/222.17; 239/222.11; 239/223; 239/252

(58) Field of Classification Search .... 239/222.11–224, 239/252, 256
See application file for complete search history.

(56) References Cited

U.S. PATENT DOCUMENTS

| | | | | |
|---|---|---|---|---|
| 3,854,664 | A | 12/1974 | Hunter | |
| RE33,823 | E | 2/1992 | Nelson et al. | |
| 7,584,904 | B2 * | 9/2009 | Townsend | 239/222.17 |
| 2007/0246560 | A1 * | 10/2007 | Townsend | 239/1 |
| 2008/0277489 | A1 * | 11/2008 | Townsend | 239/7 |
| 2008/0277498 | A1 * | 11/2008 | Townsend | 239/222.17 |

* cited by examiner

*Primary Examiner*—Christopher S Kim
(74) *Attorney, Agent, or Firm*—Nixon & Vanderhye, P.C.

(57) ABSTRACT

A dual-mode sprinkler includes a nozzle arranged to supply a stream to a rotatable water-distribution plate. The sprinkler can be adjusted between free-spinning and retarded or braked rotation, enabling multi-use applications for the sprinkler.

25 Claims, 6 Drawing Sheets

DUAL-MODE SPRINKLER HEAD

This invention relates to sprinklers for use in both agricultural and turf applications, and more specifically, to a sprinkler that can be adjusted between free-spinning and retarded or braked rotation, enabling multi-use applications for the sprinkler.

BACKGROUND OF THE INVENTION

Sprinkler heads incorporating free-spinning water-distribution plates are well known in the art as evidenced by, for example, U.S. Pat. Nos. 5,042,720 and 7,025,287. Free-spinning sprinkler devices create gentle and small droplets that can be distributed evenly across the water pattern. Other sprinklers have been designed that incorporate viscously-damped rotor plates or gear-driven rotor plates that slow the rotation of the plate as compared to a free-spinning plate. See, for example, U.S. Pat. Nos. Re. 33,823 and 3,854,664. Water-distribution or rotor plates that are slowed by whatever means, produce defined water streams with greater radius of throw and relatively larger droplets. It will be appreciated that there are suitable applications for both types of sprinklers, depending on a variety of factors.

For mechanical move irrigation systems, where the sprinkler is moving over the field, gentle and smaller water droplets are preferred at times. For example, during irrigation over bare ground or when germinating a seed piece, the gentler, smaller droplets produced from a free-spinning sprinkler do not disturb the seed piece or detrimentally impact or displace the soil structure. After the crop is established, however, and the soil surface is covered with foliage, a larger droplet is preferred to penetrate through the wind and maximize the amount of water that reaches the crop.

BRIEF SUMMARY OF THE INVENTION

In the nonlimiting exemplary embodiments described herein, free-spinning rotor technology and braked rotor technology are combined in a single, dual-mode sprinkler head.

In one of the described but nonlimiting exemplary embodiments, a sprinkler cap assembly is provided that supports a rotatable water-distribution plate on a shaft for free-spinning rotation relative to the cap assembly. The water-distribution plate is formed with at least one but typically a plurality of water-distribution grooves that may be curved in a circumferential direction such that water emitted from a nozzle and impinging on the groove or grooves will cause the water-distribution plate to rotate. The cap assembly also incorporates a viscous "rotor motor" (sometimes also referred to herein as a viscous motor assembly or speed-reducing device) of the type commonly available from the assignee of this invention. Such devices typically include a rotor component fixed to one end of a shaft within a sealed chamber that is filled or at least partially filled with a viscous fluid such as silicone. When the rotor shaft is fitted at its opposite end with a water-distribution plate, it will be appreciated that the speed of rotation of the plate will be significantly reduced as compared to a free-spinning plate. In this exemplary embodiment, a rotor motor shaft and a water-distribution plate shaft are axially aligned within the cap assembly with coupling components, for example, clutch sleeves, fixed to the adjacent free ends of the respective shafts. A threaded engagement permits a first cap subassembly that includes the water-distribution plate to be rotated and thus moved axially toward or away from a second cap subassembly that includes the viscous rotor motor. This axial movement also causes the respective clutch sleeves to engage or disengage, depending on the direction of rotation of the first cap subassembly.

In a second nonlimiting embodiment, a manually rotatable cap or ring is provided atop the sprinkler, the cap enabling the user to place the sprinkler in either a free-spinning mode or a reduced-speed mode. More specifically, the cap controls a ratchet and pawl coupling device that, when disengaged, allows free spinning of the viscous motor housing along with the water-distribution plate and its shaft, and when engaged, prevents rotation of the viscous motor housing, such that the viscous motor assembly resists rotation of the shaft and the water-distribution plate.

The ability of the sprinkler described herein to change from a free-spinning sprinkler to a slow-rotating sprinkler when used on mechanical move irrigation systems, optimizes the performance through the life cycle of the crop and through the irrigation season.

For solid set irrigation on tree and vine crops, there are also times when this ability to adjust between a free-spinning and brake rotation are beneficial. For example, when a tree is young, the root zone is small. Utilizing the multi-use application of the sprinkler in the free-spinning mode early in a tree crop's life maximizes the amount of water delivered to the root zone. As the tree matures and the root zone expands, the adjustment of the sprinkler to the brake rotation mode increases the radius of throw significantly, thereby providing a wetted pattern across the expanded root zone and promoting growth.

Accordingly, in one aspect, the present invention relates to a dual-mode sprinkler comprising a nozzle arranged to supply a stream to a water-distribution plate mounted on one end of a first rotatable shaft; a speed-retarding device mounted on a second rotatable shaft arranged substantially coaxially with the first shaft; wherein adjacent free ends of the first and second shafts are fitted with respective first and second coupling components movable axially relative to each other between engaged and disengaged positions to thereby alter the sprinkler between free-spinning and retarded-spinning modes.

In another aspect, the invention relates to a dual-mode sprinkler comprising a sprinkler body incorporating a nozzle; a cap assembly attached to the sprinkler body downstream of the nozzle, the cap assembly having a first subassembly comprising a cap component and a water-distribution plate fixed to one end of a first rotatable shaft that extends through the cap component, an opposite free end of the first shaft having a first clutch sleeve fixed thereto for rotation with the water-distribution plate; and a second cap subassembly including a speed-retarding device supported in a housing, a second clutch sleeve fixed to a free end of a second rotatable shaft in substantially axially alignment with the first clutch sleeve; wherein the first cap subassembly is axially movable relative to the second cap subassembly to thereby cause engagement or disengagement of the first and second clutch sleeves, and wherein rotation of the first shaft and the water-distribution plate is slowed when the clutch sleeves are engaged.

In still another aspect, the invention relates to a dual-mode sprinkler comprising a nozzle arranged to supply a stream to a water-distribution plate mounted on one end of a first rotatable shaft; a speed-retarding device mounted on a second rotatable shaft arranged substantially coaxially with the first shaft, adjacent free ends of the first and second shafts fitted with respective first and second clutch sleeves movable relative to each other between engaged and disengaged positions; wherein each of the first and second clutch sleeves have a toothed peripheral edge formed thereon; wherein the speed-retarding device and the second clutch sleeve are supported in a housing, and the water-distribution plate and the first clutch sleeve are supported by a cap, the cap threadably engaged with the housing, whereby relative rotation between the housing and the cap will cause axial movement of the second clutch sleeve toward or away from the first clutch sleeve, the relative rotation limited to prevent separation of the housing and the cap; the axial movement enabling the first and second clutch sleeves to move between disengaged and engaged positions to thereby enable the sprinkler to operate in free-spinning and retarded-spinning modes; and wherein the speed-retarding device comprises a rotor fixed to the second shaft and located within a chamber at least partially filled with a viscous fluid.

In still another aspect, the invention relates to a dual-mode sprinkler head comprising a sprinkler body having a nozzle arranged to supply a stream to a water-distribution plate supported on one end of a rotatable shaft in spaced relationship to said nozzle; a speed-retarding device including a housing supported in the sprinkler body, an opposite end of the shaft received in the housing; and a coupling device selectively movable into or out of engagement with the housing; wherein, when the coupling device is not engaged with the housing, the housing rotates with the shaft and the water-distribution plate in a free-spinning mode, and when the coupling device is engaged with the housing, the housing is stationary and the shaft and the water-distribution plate rotate relative to the housing in a reduced-speed mode.

The invention will now be described in detail in connection with the drawings identified below.

DETAILED DESCRIPTION OF THE DRAWINGS

Figure 1:
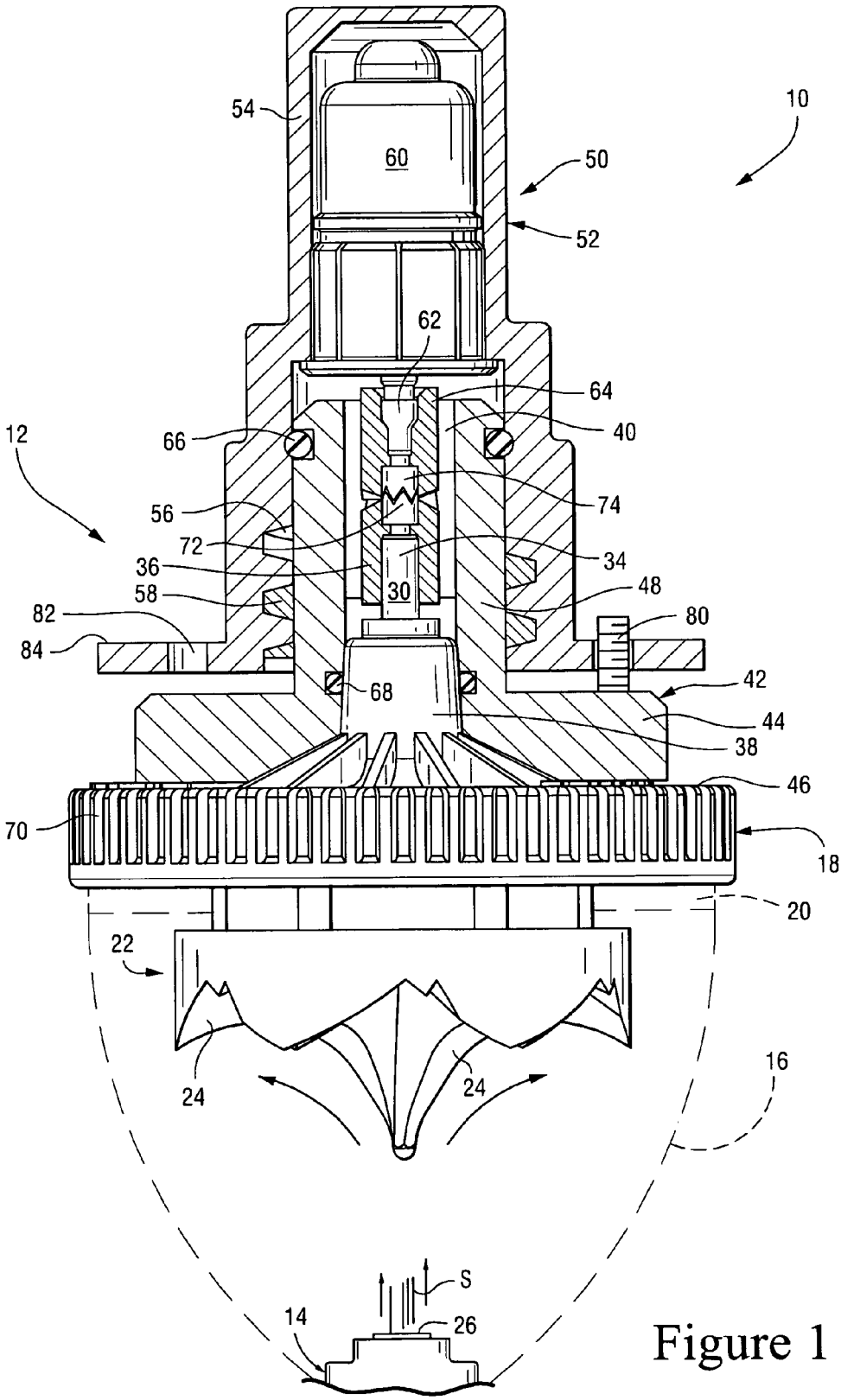
FIG. 1 is a partial cross-sectional view through a dual-mode sprinkler head in accordance with a first nonlimiting exemplary embodiment, showing speed-regulating coupling components in an engaged position.
Figure 2:
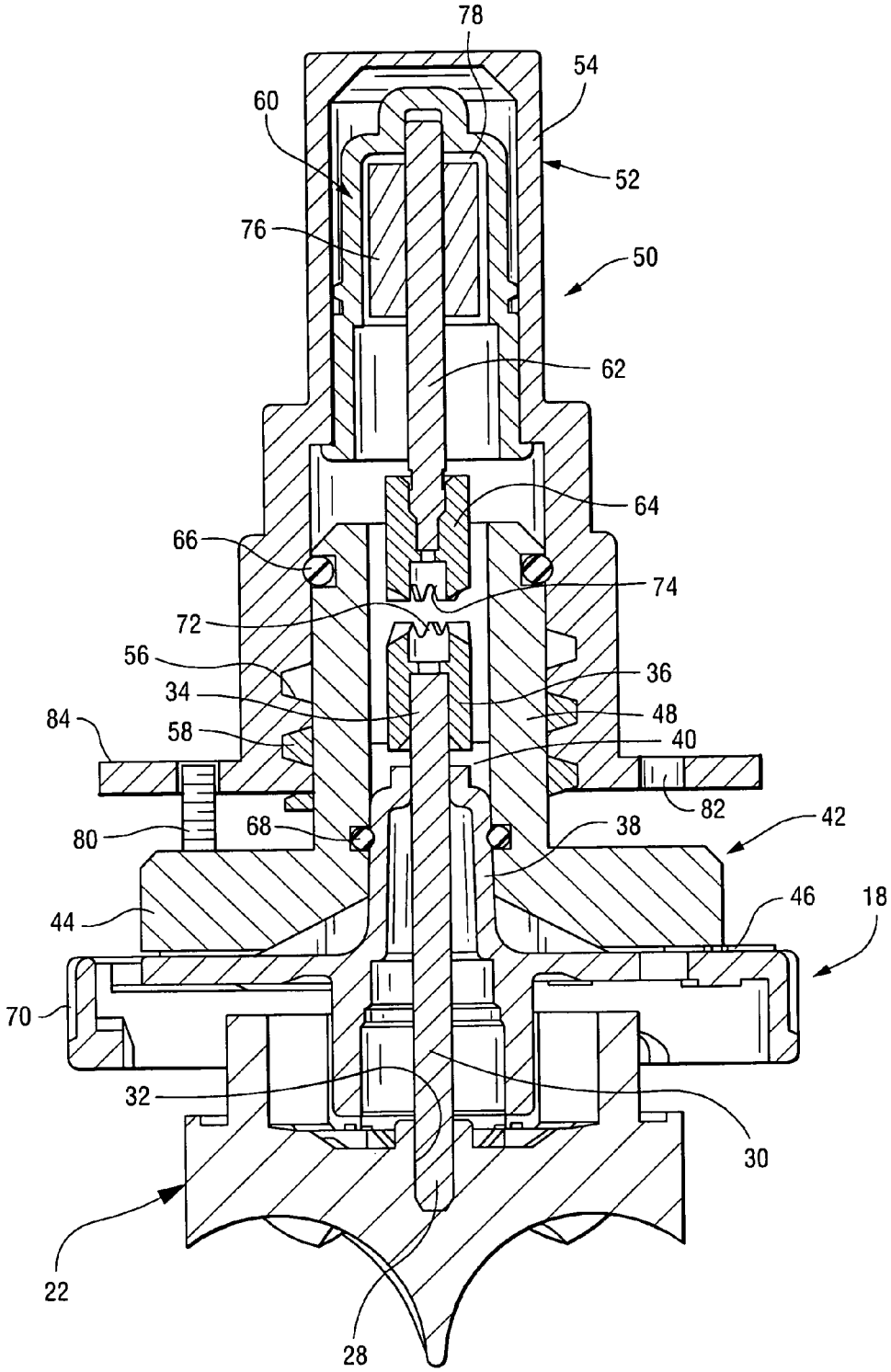
FIG. 2 is a cross-sectional view similar to FIG. 1 but with additional components sectioned and some parts removed for clarity, illustrating the coupling components in a disengaged position.

With reference to FIGS. 1 and 2, the sprinkler 10 includes a cap assembly 12 that may be removably attached to a sprinkler body/nozzle 14 by means of one or more struts 16 (typically three, two of which are shown in phantom), with a threaded or other connection between an annular cap component 18 and an annular ring 20 (also shown in phantom) extending about the upper end of the struts. A water-distribution plate 22 is rotatably supported in the cap assembly and is formed with one or more grooves 24, at least one of which is curved in a circumferential direction, causing the plate 22 to rotate when impinged upon by a stream S issued from a nozzle 26 in the sprinkler body. This arrangement is well known in the art and need not be described in any further detail.

Of importance here is control of the speed of rotation of the water-distribution plate 22. As shown in FIG. 2, the plate 22 is supported on one end 28 of a shaft 30 press-fit into a blind bore 32 on the back side of the plate 22. The shaft 30 extends upwardly (in the illustrated but nonlimiting sprinkler orientation) into and through the cap component 18, with an opposite end 34 of the shaft 30 supporting a first rotational speed-regulating coupling component in the form of a clutch sleeve 36, fixed to the shaft by a press-fit or other suitable arrangement. An upwardly extending, centered inner hub 38 of the cap component 18 is received within a bore 40 formed in a concentrically arranged upper cap holder 42, a base or flange portion 44 of which is fixed (by screws, for example) to an upper surface 46 of the cap component 18.

The cap holder 42 is also formed with a center hub 48, referred to herein as an outer hub to distinguish it from the inner hub 38. The bore 40 which receives the inner hub 38 extends through the outer hub 48, such that outer hub 48 is concentrically telescoped over the inner hub 38. As a result, the shaft 30 and first clutch sleeve 36 are also located within the bore 40. This group of components including the cap component 18, water-distribution plate 22, shaft 30 and cap holder 42 may be regarded as a first cap subassembly.

A second cap subassembly 50 includes a hollow housing 52 formed with a peripheral side wall 54 with an internal thread 56 at its lower end that engages a complimentary external thread 58 on the exterior surface of the outer hub 48. A rotor "motor" component 60 of the subassembly 50 is located within a closed end of the housing 52, with a motor shaft 62 axially aligned with the shaft 30. The shaft 62 mounts a second rotational speed-regulating coupling component in the form of a clutch sleeve 64 that is axially aligned and closely adjacent the first clutch sleeve 36. Bore 40 and the area between outer hub 48 and motor 60 is filled with grease or other suitable lubricant, and sealed by O-rings 66, 68.

With this arrangement, it will be appreciated that rotation of the first cap subassembly via the knurled edge 70 of the cap component 18, relative to the second cap subassembly will move the clutch sleeves 36 and 64 axially toward or away from each other, depending on the direction of rotation of the first cap subassembly. In this regard, note that the relative rotation can be effected by holding the second cap subassembly and rotating the first cap subassembly, or vice versa. In either case, the clutch sleeves 36 and 64 may be moved into engaged or disengaged positions. Toothed peripheral edges 72, 74 on the free ends of the respective clutch sleeves, facilitate engagement and locked rotation when so engaged.

FIG. 2 illustrates the clutch sleeves 36 and 64 in a disengaged position, permitting the shaft 30 and water-distribution plate 22 to spin freely, driven by the stream S impinging on the one or more grooves 24 in the plate.

By relatively rotating the cap subassemblies as described above, the clutch sleeves 36, 64 may be caused to engage (as shown in FIG. 1), thereby directly connecting the plate shaft 30 to the motor shaft 62. Now, the viscously damped rotor motor significantly slows the speed of rotation of the water-distribution plate 22. By way of comparison, the water-distribution plate may rotate at speeds as high as about 1800 rpm when the clutch sleeves are disengaged, and as low as about 12 rpm when the sleeves are engaged. The degree of braking or speed-retardation may be varied by changing the viscosity of the fluid in the motor 60.

The rotor motor component 60 may be similar to those commercially used by the assignee in a variety of its sprinkler products, and as disclosed in, for example, U.S. Pat. Nos. Re. 33,823; 4,796,811; and 5,224,653. While the preferred speed-retarding mechanism is viscous damping, other suitable speed control devices such as gear drives may also be used.

A viscous motor as described in the above-identified patents may include a solid rotor 76 fixed to the shaft 62 inside a sealed chamber 78 (seals not shown) in the housing, with the chamber filled or at least partially filled with a viscous fluid such as silicone. The viscous shearing of the fluid between the rotor and motor wall significantly slows rotation of the shaft and, with the clutch sleeves engaged, the water-distribution plate as well. By varying the viscosity of the fluid in the chamber 78, the degree of braking may be altered to achieve a desired radius of throw.

To facilitate movement of the clutch sleeves 36, 64 (or other suitable coupling components) between disengaged and engaged positions, and vice versa, the threads 56, 58 may be set up such that only a half turn is required to move between a clutch-engaged (slow rotation) position to a clutch-disengaged (fast rotation) position. In addition, in order to prevent a complete separation of the first cap subassembly from the second cap subassembly, and clutch sleeve 36 from the cap, a stop 80 may be mounted onto cap holder 42 so that the user is only able to make whatever turn is necessary to adjust the sprinkler mode. Depending on the thread pitch, a half turn may be sufficient to separate the clutch sleeves by about 0.100 inch, enough to change the sprinkler from a slow or retarded mode to a fast or free-spinning mode.

Figure 3:
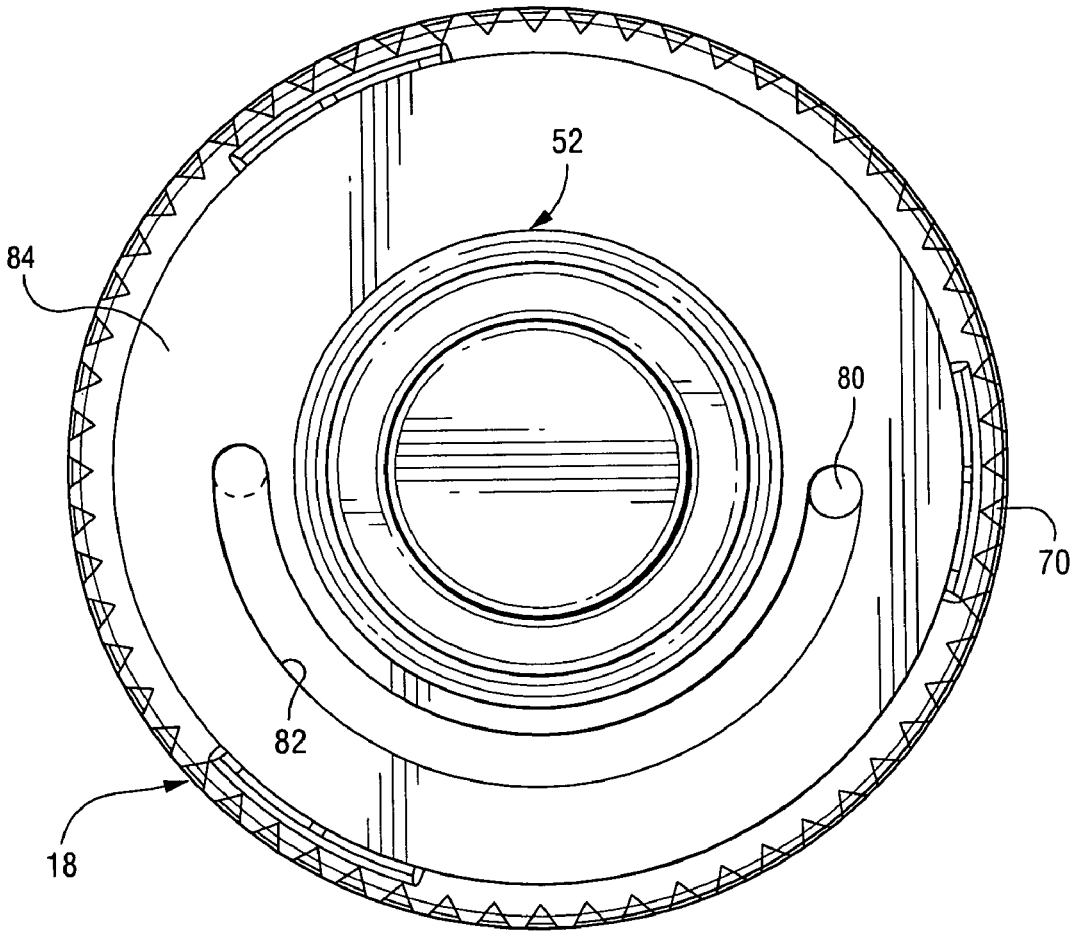
FIG. 3 is a top plan view of the sprinkler shown in FIGS. 1 and 2.

The stop 80 may be in the form of a pin projecting upwardly from the flanged portion 44 of the outer hub 48, received in a slot 82 formed in a flanged portion 84 of the housing 52. As best seen in FIG. 3, the slot 82 may extend about 180° but the arcuate extent may vary as needed to be consistent with the pitch of the threads on the cap and housing that determine the amount of rotation needed to engage and disengage the clutch sleeves.

Figure 4:
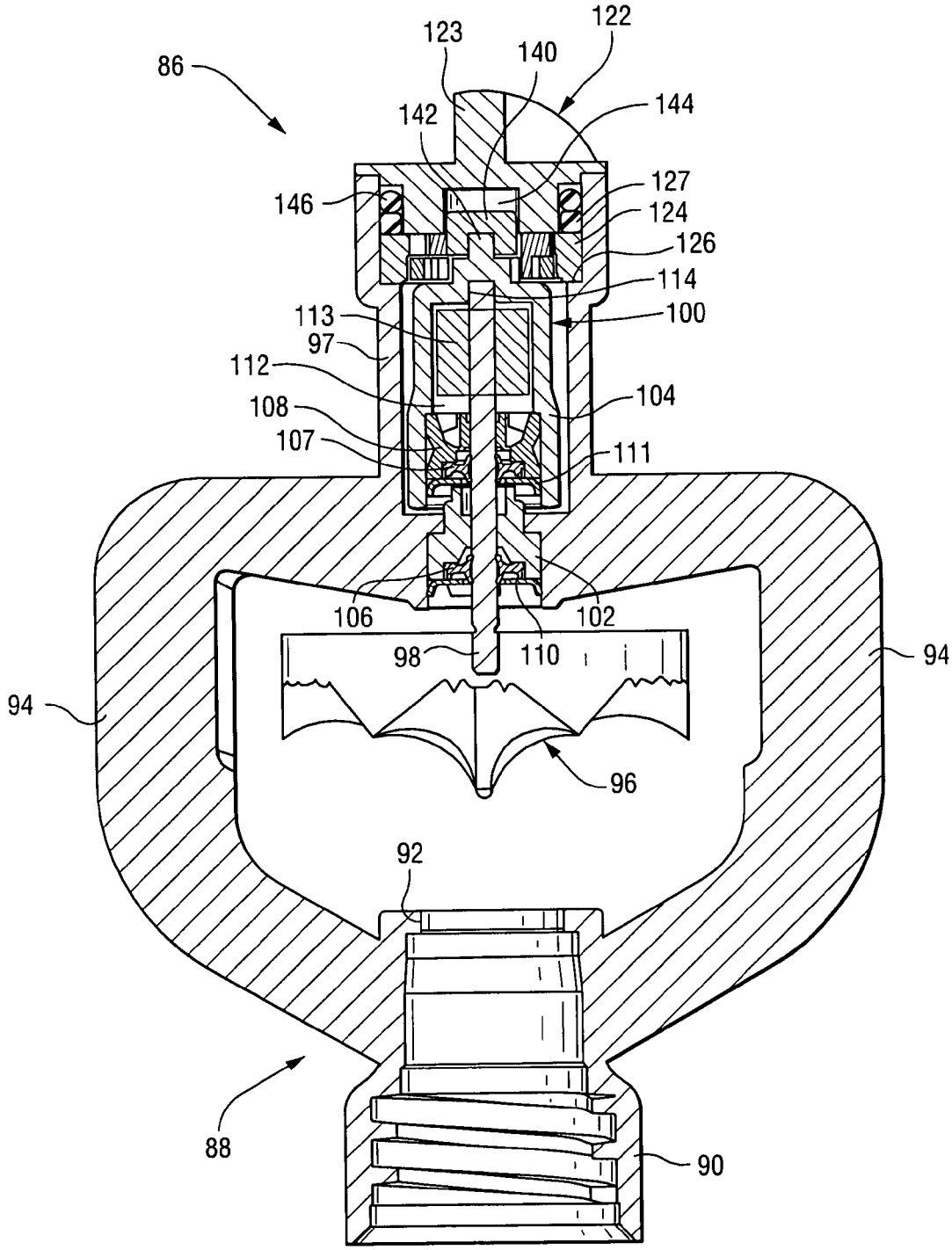
FIG. 4 is a partial cross-sectional view of a dual-mode sprinkler in accordance with a second, nonlimiting exemplary embodiment.
Figure 5:
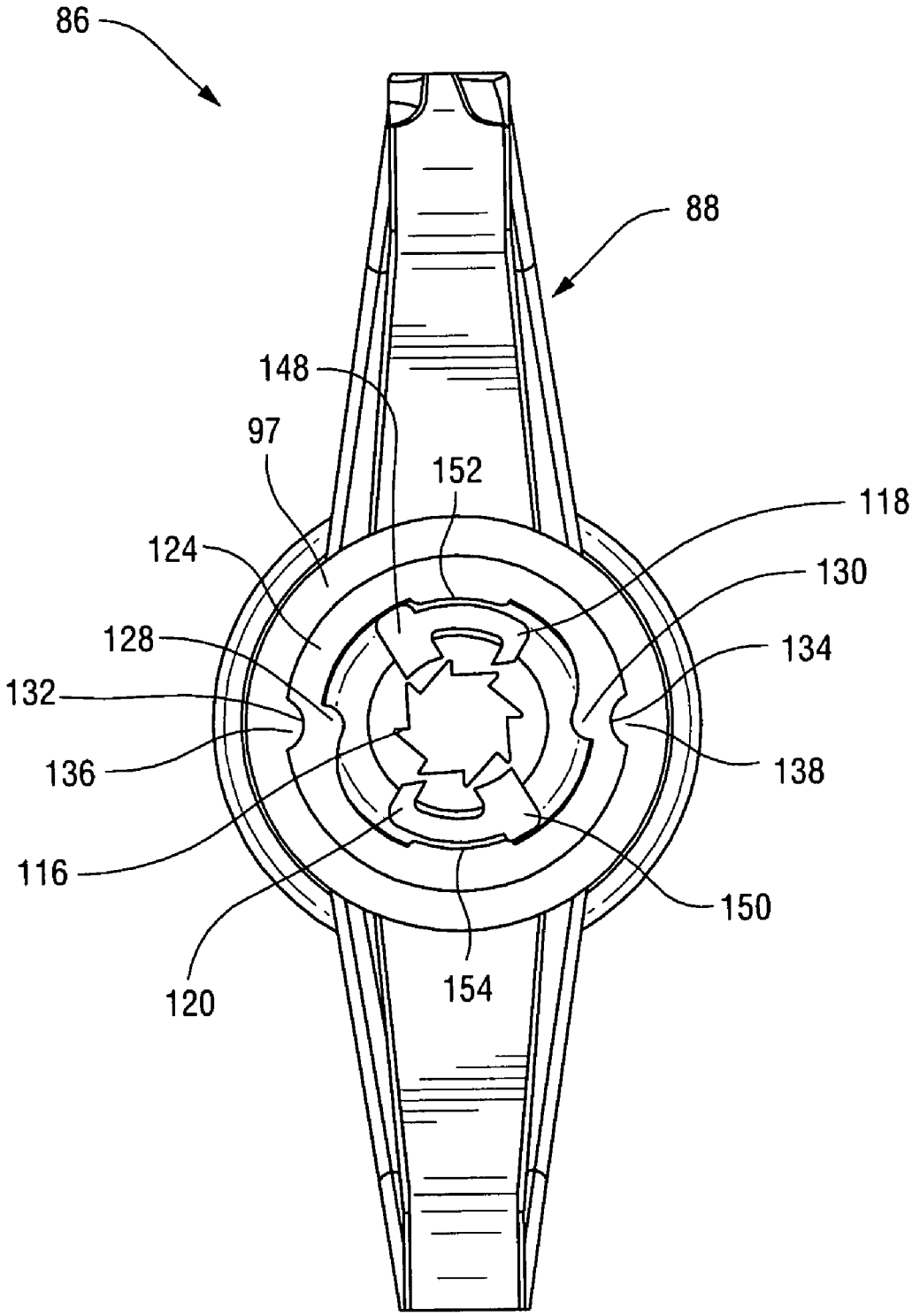
FIG. 5 is a plan view of the sprinkler shown in FIG. 4 with an actuator disk removed, showing a coupling mechanism in a free-spinning mode.
Figure 6:
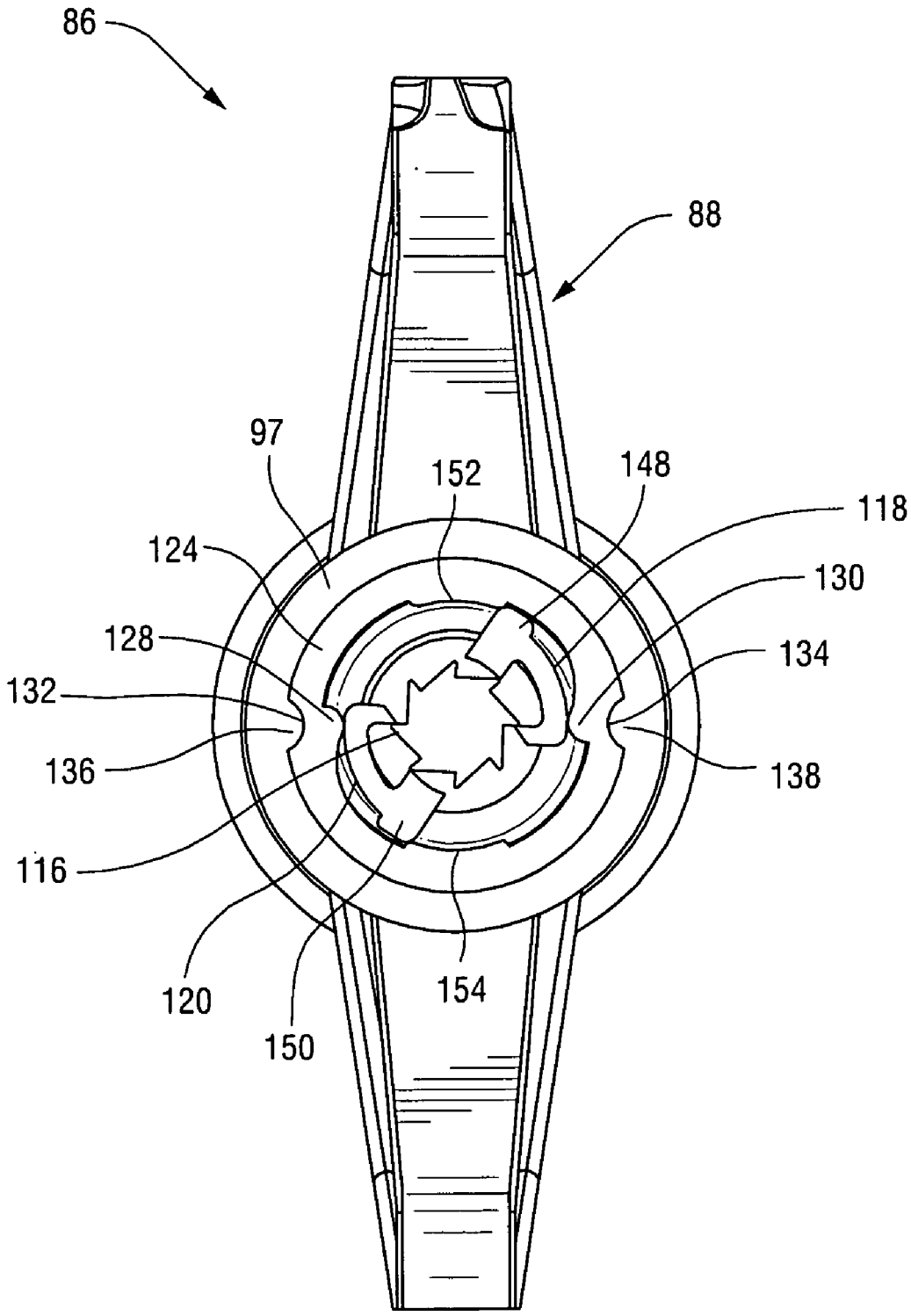
FIG. 6 is a view similar to FIG. 5 but showing the coupling mechanism in a reduced-speed mode.

A second nonlimiting, exemplary embodiment is illustrated in FIGS. 4 through 6. The sprinkler 86 is composed of a body 88 that includes an adaptor portion 90 for attachment to a water supply conduit (not shown), an integral nozzle 92, and two or more struts 94 that support a water deflection or distribution plate 96 on a shaft 98. The body also includes a generally cylindrical housing portion 97 extending above the struts, and enclosing a viscous motor assembly 100 which receives one end of the shaft 98. The opposite end of the shaft 98 supports the distribution plate 96 for rotation with the shaft. As is well known in the art, the plate 96 is formed with a plurality of grooves configured to cause the plate to rotate when the stream emitted from the nozzle 92 strikes the plate.

The shaft 98 passes through a lower support bearing 102 press-fit into the body 88 and supporting a seal 106 secured by a retainer 110. The shaft also passes through a second bearing 108 press-fit into one end of the motor housing 104 and supporting another seal 107 secured by retainer 111. The shaft then extends into a viscous fluid chamber 112, passing through a rotor 113 press-fit to it and terminates in a recess 114 formed in the opposite end of the housing 104.

The external motor housing surface above the recess 114 is formed with a plurality of ratchet teeth 116, best seen in FIGS. 5 and 6, that are adapted to be engaged by a pair of flexible pawl elements or dogs 118, 120 formed on the lower end of a manually operable actuator disk 122 (FIG. 4) mounted for rotation in the upper, open end of the body housing portion 97. The actuator disk 122 is easily manipulated (i.e., rotated) by incorporation of a raised tab 123. An annular cam ring 124 is supported on a shoulder 126 formed in the body housing portion 97, held in place by a retainer 127 (FIG. 4). The radially inner edge surface of the cam ring 124 is provided with a pair of radially inwardly directed cam lobes 128, 130, while the radially outer edge surface of the ring 124 is formed with a pair of diametrically opposed recesses or cut-outs 132, 134 that receive a respective pair of lugs 136, 138 formed on the inner surface of the body housing portion 97 (FIGS. 5, 6). These features prevent the annular cam ring 124 from rotating.

The annular cam ring 124 has a center dome portion 140 that is counterbored to receive the tip 142 of the motor housing 104. This locates the tip 142 of the motor housing 104 axially and radially within the assembly 86. The actuator disk 122 is formed with an internal, center recess 144 that clears the center dome portion 140 that permits the actuator disk 122 to be turned relative to the annular cam ring 124 and the viscous motor housing 104 (as well as the cylindrical housing portion 97). An o-ring 146 is interposed between the upper, inner surface of the actuator disk 122 and the retainer 127.

As best seen in FIG. 5, the pawl elements or dogs 118, 120 are in their normal position, spaced outwardly of the ratchet teeth 116, so that the motor housing 104 is free to spin with the shaft 98 and water-distribution plate 96 in a nonresistance or free-spinning mode. In other words, when the shaft rotates with the viscous motor housing 104, the viscous motor is ineffective to resist rotation of the shaft. Rotating the cap 122 in clockwise direction will cause the flexible pawl elements or dogs 118, 120 to engage the cam lobes 128, 130 causing the pawl elements or dogs to flex radially inwardly, into engagement with the ratchet teeth 116 as shown in FIG. 6. This engagement arrests the rotation of the viscous motor housing 104, so that the rotation of the shaft 98 is now viscously damped by the fluid in chamber 112, slowing the rotation of the distribution plate 96.

Note that the enlarged end portions 148, 150 of the pawl elements 118, 120 move across shouldered surfaces 152, 154, respectively on the inner edge of the cam ring 124, so that in both the free-spinning and reduced-speed modes, the pawl elements are held in position in the arcuate detent areas on either side of the shouldered surfaces. At such time as it is desired to move back to a free-spinning mode, the actuator disk 122 is simply rotated back in the counterclockwise direction so that the cam lobes release the pawl elements from engagement with teeth 116.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A dual-mode sprinkler comprising:

a nozzle arranged to supply a stream to a water-distribution plate mounted on one end of a first rotatable shaft;

a speed-retarding device mounted on a second rotatable shaft arranged substantially coaxially with said first shaft;

wherein adjacent free ends of said first and second shafts are fitted with respective first and second coupling components movable axially relative to each other between engaged and disengaged positions to thereby alter said sprinkler between free-spinning and retarded-spinning modes.

2. The sprinkler of claim 1 wherein each of said first and second coupling components have a toothed peripheral edge formed thereon.

3. The sprinkler, of claim 1 wherein said speed-retarding device and said second coupling component are supported in a housing, and said water-distribution plate and said first coupling component are supported by a cap holder, said cap holder threadably engaged with said housing, whereby relative rotation between said housing and said cap holder will cause axial movement of said second coupling component toward or away from said first coupling component.

4. The sprinkler of claim 1 wherein said speed-retarding device comprises a rotor fixed to said second shaft and located within a chamber at least partially filled with a viscous fluid.

5. The sprinkler of claim 1 and further comprising a stop limiting rotation between said cap holder and said housing.

6. The sprinkler of claim 5 wherein said stop comprises a pin projecting from said cap holder and received within an arcuate slot in said housing.

7. The sprinkler of claim 6 wherein said arcuate slot is formed in a horizontal flange of said housing.

8. The sprinkler of claim 1 wherein said nozzle is mounted in a sprinkler body, and said water-distribution plate and said speed-retarding device are part of cap assembly supported downstream of said nozzle by one or more struts extending between said sprinkler body and said cap assembly.

9. A dual-mode sprinkler comprising:

a sprinkler body incorporating a nozzle;

a cap assembly attached to said sprinkler body downstream of said nozzle, said cap assembly having a first subassembly comprising a cap component and a water-distribution plate fixed to one end of a first rotatable shaft that extends through said cap component, an opposite free end of said first shaft having a first clutch sleeve fixed thereto for rotation with said water-distribution plate;

a second cap subassembly including a speed-retarding device supported in a housing, a second clutch sleeve fixed to a free end of a second rotatable shaft in substantially axially alignment with said first clutch sleeve;

wherein said first cap subassembly is axially movable relative to said second cap subassembly to thereby cause engagement or disengagement of said first and second clutch sleeves, and wherein rotation of said first shaft and said water-distribution plate is slowed by a speed-retarding device when said clutch sleeves are engaged.

10. The sprinkler of claim 9 wherein each of said first and second clutch sleeves have a toothed peripheral edge formed thereon.

11. The sprinkler of claim 9 wherein said speed-retarding device comprises a rotor fixed to said second shaft and located within a chamber at least partially filled with a viscous fluid.

12. The sprinkler of claim 9 and further comprising a stop limiting rotation between said first cap subassembly and said second cap subassembly.

13. The sprinkler of claim 12 wherein said stop comprises a pin projecting from a cap holder component of said first cap subassembly and received within an arcuate slot in said housing.

14. The sprinkler of claim 13 wherein said arcuate slot is formed in a horizontal flange of said housing.

15. The sprinkler of claim 9 wherein said nozzle is mounted in a sprinkler body, and said water-distribution plate and said speed-retarding device are part of cap assembly supported downstream of said nozzle by one or more struts extending between said sprinkler body and said cap assembly.

16. A dual-mode sprinkler comprising:

a nozzle arranged to supply a stream to a water-distribution plate mounted on one end of a first rotatable shaft;

a speed-retarding device mounted on a second rotatable shaft arranged substantially coaxially with said first shaft, adjacent free ends of said first and second shafts fitted with respective first and second clutch sleeves movable relative to each other between engaged and disengaged positions;

wherein each of said first and second clutch sleeves have a toothed peripheral edge formed thereon; and wherein said speed-retarding device and said second clutch sleeve are supported in a housing, and said water-distribution plate and said first clutch sleeve are supported by a cap holder, said cap holder threadably engaged with said housing, whereby relative rotation between said housing and said cap holder causes axial movement of said second clutch sleeve toward or away from said first clutch sleeve, said relative rotation limited to prevent separation of said housing and said cap holder; said axial movement enabling said first and second clutch sleeves to move between disengaged and engaged positions to thereby enable said sprinkler to operate in free-spinning and retarded-spinning modes.

17. The sprinkler of claim 16 wherein said speed-retarding device comprises a rotor fixed to said second shaft and located within a chamber at least partially filled with a viscous fluid.

18. The sprinkler of claim 16 wherein an annular cap component is fixed to said cap holder, said annular cap component having a knurled peripheral edge to facilitate rotation of said cap holder relative to said housing.

19. A dual-mode sprinkler head comprising:

a sprinkler body having a nozzle arranged to supply a stream to a water-distribution plate supported on one end of a rotatable shaft in spaced relationship to said nozzle;

a speed-retarding device including a housing supported in said sprinkler body, an opposite end of said shaft received in said housing; and a coupling device selectively movable into or out of engagement with said housing;

wherein, when said coupling device is not engaged with said housing, said housing rotates with said shaft and said water-distribution plate in a free-spinning mode, and when said coupling device is engaged with said housing, said housing is stationary and said shaft and said water-distribution plate rotate relative to said housing in a reduced-speed mode.

20. The sprinkler of claim 19 wherein said coupling device is actuated by a manually operable actuator disk atop said sprinkler body.

21. The sprinkler of claim 20 wherein said actuator disk is formed with at least one flexible pawl element engageable with teeth formed on an external surface of said housing.

22. The sprinkler of claim 21 wherein said at least one flexible pawl element is moved into engagement with said teeth by engagement of said at least one pawl element with a stationary cam lobe upon rotation of said actuator disk.

23. The sprinkler of claim 21 wherein said actuator disk is formed with a pair of diametrically opposed, flexible pawl elements, and said housing is provided with a fixed ring formed with a pair of diametrically opposed cam lobes, wherein rotation of actuator disk causes said flexible pawl elements to engage said cam lobes, pushing said flexible pawl elements into engagement with said teeth formed on said housing, thus preventing said housing from rotating with said shaft in said reduced-speed mode.

24. The sprinkler of claim 19 wherein said speed-reducing device comprises a chamber in said housing at least partially filled with a viscous fluid, such that, in said reduced-speed mode, said viscous fluid resists rotation of said shaft.

25. The sprinkler of claim 23 wherein said speed-reducing device comprises a chamber in said housing at least partially filled with a viscous fluid, such that, in said reduced-speed mode, said viscous fluid resists rotation of said shaft.

* * * * *